US009698499B2

(12) United States Patent
Chen et al.

(10) Patent No.: US 9,698,499 B2
(45) Date of Patent: Jul. 4, 2017

(54) WALL MOUNT COMPONENT AND WIRE CLAMP CONNECTOR THEREOF

(71) Applicant: ADVANCED-CONNECTEK INC., New Taipei (TW)

(72) Inventors: Jin-Shi Chen, New Taipei (TW); Pin-Yuan Hou, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/184,524

(22) Filed: Jun. 16, 2016

(65) Prior Publication Data

US 2016/0372843 A1 Dec. 22, 2016

(30) Foreign Application Priority Data

Jun. 18, 2015 (CN) ..... 2015 1 0339268

(51) Int. Cl.

| | |
|---|---|
| ***H01R 4/42*** | (2006.01) |
| ***H01R 4/36*** | (2006.01) |
| ***H01R 13/24*** | (2006.01) |
| ***H01R 13/73*** | (2006.01) |
| ***H01R 24/68*** | (2011.01) |

(Continued)

(52) U.S. Cl.

CPC ..... *H01R 4/42* (2013.01); *H01R 4/366* (2013.01); *H01R 13/2421* (2013.01); *H01R 13/73* (2013.01); *H01R 24/68* (2013.01); *H01R 24/76* (2013.01); *H01R 25/145* (2013.01);

(Continued)

(58) Field of Classification Search

CPC ..... H01R 4/42

See application file for complete search history.

(56) References Cited

U.S. PATENT DOCUMENTS 4,529,261 A * 7/1985 Stenz ..... H01R 4/363 439/810

4,772,218 A * 9/1988 Ross ..... H01R 4/4818 439/387

(Continued)

FOREIGN PATENT DOCUMENTS

DE 102012016464 B3 7/2013

GB 2420917 A 6/2006

OTHER PUBLICATIONS

Search Report issued Oct. 19, 2016 in corresponding EP Application 16174709.2 (in English).

*Primary Examiner* — James Harvey

(74) *Attorney, Agent, or Firm* — Muncy, Geissler, Olds & Lowe, P.C.

(57) ABSTRACT

A wire clamp connector includes a connecting board, a plurality of conductive sheets, a plurality of conductive mounts, and a plurality of wire clamp components. The conductive sheets are disposed at one surface of the connecting board. The conductive mounts are disposed at the top of the connecting board and connected to the conductive sheets. The wire clamp components are disposed at the respective conductive mounts. Each of the wire clamp components includes a lock member and a clamping piece. The lock member pushes the clamping piece to push against a wire, so that the wire can be firmly positioned with the corresponding conductive mount. Furthermore, the wire clamp connector may be applied to the wall mount component so as to be mounted on a wall and connected to an electronic product.

10 Claims, 8 Drawing Sheets

(51) Int. Cl.

| | |
|---|---|
| ***H01R 24/76*** | (2011.01) |
| ***H01R 25/14*** | (2006.01) |
| ***H01R 31/06*** | (2006.01) |
| *H01R 103/00* | (2006.01) |

(52) U.S. Cl.
CPC ..... *H01R 31/06* (2013.01); *H01R 2103/00* (2013.01); *H01R 2201/18* (2013.01)

(56) References Cited

U.S. PATENT DOCUMENTS 5,192,234 A * 3/1993 Heng ..... H01R 4/363 439/709
5,415,563 A * 5/1995 Shan ..... H01R 4/4818 439/439
5,622,517 A * 4/1997 Heng ..... H01R 4/2433 439/417
6,159,057 A * 12/2000 Bernardini ..... H01R 13/639 439/259
7,303,433 B1 * 12/2007 Scholeno ..... H01R 11/26 439/552

* cited by examiner

WALL MOUNT COMPONENT AND WIRE CLAMP CONNECTOR THEREOF

CROSS-REFERENCES TO RELATED APPLICATIONS

This non-provisional application claims priority under 35 U.S.C. §119(a) on Patent Application No. 201510339268.2 filed in China, P.R.C. on 2015 Jun. 18, the entire contents of which are hereby incorporated by reference.

FIELD OF THE INVENTION

The instant disclosure relates to an electrical connector, and more particular to a wall mount component and a wire clamp connector thereof.

BACKGROUND

Generally, an electronic device is electrically connected to the main supply, so the electronic device can be driven by the main supply. In other words, the electronic device and the main supply are electrically connected with each other by two mating connectors. A bracket having a connector is fixed on a wall and the connector is connected to the main supply. When the electronic device is placed on the bracket, the connector of the electronic device is electrically connected with the connector of the bracket to receive the electrical power from the main supply.

Conventionally, in the assembling of the positive and negative wires of the main supply and the connector assembled with the bracket (herein called bracket connector), the positive and negative wires are inserted into the bracket connector, and then several screws of the bracket connector are locked with the wires, so that the wires can be electrically connected to the bracket connector and positioned in the bracket connector.

SUMMARY OF THE INVENTION

In conventional, the wires are positioned with the connector by threading with screws. However, the area of the tip of the screw is too small to position the wire on the connector properly; namely, when the screw is threaded to lock the wire with the connector, the tip of the screw cannot be aimed at the wire, so that the wire cannot be securely positioned on the connector. In addition, when screws are applied to position the wires on the connector, the wires might be damaged, broken, or cut by the tips of the screws because of the sharp protrusions or rough surface of the screw's tip. Consequently, the electrical transmission would be harmed. Accordingly, how to improve the existing connector becomes an issue.

In view of this, an embodiment of the instant disclosure provides wire clamp connector. The wire clamp connector comprises a connecting board, a plurality of conductive sheets, a plurality of conductive mounts, and a plurality of wire clamp components. The connecting board comprises a board body, a plurality of recessed rails at a lateral surface of the board body, a plurality of assembling holes at side portions of a top of the board body, and a plurality of through holes at two sides of the board body and communicating with the respective assembling holes. The conductive sheets are disposed at the lateral surface of the board body. Each of the conductive sheets comprises a contact plate and an assembling portion. Each of the contact plates is positioned in the corresponding recessed rail. Each of the assembling portions is extending laterally from the contact plate toward the corresponding assembling hole. The conductive mounts are disposed at the board body. Each of the conductive mounts comprises a mount body, a positioning portion, a wire groove, and a lock hole. Each of the mount bodies is positioned in the corresponding assembling hole. Each of the positioning portions is formed at one of two sides of the mount body and connected to the corresponding assembling portion. Each of the wire grooves is defined through the mount body. Each of the lock holes is formed at the other side of the mount body and corresponds to the corresponding through hole. The wire clamp components are disposed at the mount bodies, respectively. Each of the wire clamp components comprises a lock member and a clamping piece. The lock members are locked with the lock holes, respectively. Each of the lock members comprises a rod, an abutting portion, and a lock groove. The abutting portion is at one of two ends of the rod and positioned in the corresponding wire groove. The lock groove is at the other end of the rod and protruding from the corresponding through hole. The clamping pieces are disposed in the wire grooves, respectively. Each of the clamping pieces comprises a holding sheet, a bending portion, and a contact sheet. Each of the holding sheets is assembled to the corresponding abutting portion. One of two ends of the bending portion is extending from a bottom of the holding sheet, and the contact sheet is extending from the other end of the bending portion and near to the holding sheet.

In some embodiments, each of the holding sheets comprises a recessed groove and a plurality of side arms, the recessed groove is recessed from a top of the holding sheet, and the side arms are at two sides of the recessed groove. Each of the lock members comprises an annular groove between the rod and the abutting portion, and the side arms are respectively positioned at two sides of the annular groove.

In some embodiments, each of the clamping pieces comprises a flexible space formed between the holding sheet and the contact sheet, and the abutting portion is disposed in the flexible space.

In some embodiments, each of the clamping pieces comprises a guiding portion extending and being bent inwardly from a side of the contact sheet.

In some embodiments, each of the wire clamp components comprises a cover plate covering the wire groove of the corresponding mount body.

In some embodiments, each of the assembling portions comprises a buckle piece extending from the contact plate and extending upward and inward to a position above the contact plate. Each of the positioning portions comprises a protruding block and a buckle groove. The protruding block is laterally protruding from the mount body, the buckle groove is recessed from the surface of the protruding block, and the buckle piece is fixed in the corresponding buckle groove. In addition, each of the conductive sheets comprises a recessed portion formed at one side of the contact plate and near to the buckle piece, and each of the conductive mounts comprises an engaging block laterally protruding from the protruding block and assembled to the corresponding recessed portion.

In some embodiments, the connecting board comprises a plurality of engaging grooves respectively recessed from inner walls of each of the recessed rails and aligned staggeringly, wherein each of the conductive sheets comprises a plurality of engaging pieces respectively and bilaterally extending from each of the contact plates and aligned staggeringly, the engaging pieces are engaged with the respective engaging grooves.

Another embodiment of the instant disclosure provides a wall mount component. The wall mount component comprises a bracket, a plurality of hooks bilaterally extending from the bracket, and the aforementioned wire clamp connector. The wire clamp connector is assembled to one surface of the bracket. In addition, the wall mount component further comprises a connecting pad, a plurality of engaging holes recessed from two sides of the connecting pad, and a plurality of conductive terminals assembled to one surface of the connecting pad and connected to the wire clamp connector.

Based on the above, the wire can be firmly positioned in the wire groove by the clamp piece having a flat surface, so that the wire would not be damaged easily as well as the wire can be in contact with the clamping piece. In addition, because the offset configuration of the engaging pieces of the conductive sheets, when the engaging pieces are respectively positioned with the engaging grooves of the connecting board, the fixation between the conductive sheets and the connecting board can be enhanced. Moreover, the abutting portion of the lock member is positioned in the U-shaped clamping piece, and the head of the abutting portion is in the flexible space of the clamping piece. The abutting portion is free from contacting the contact sheet of the clamping piece. When the contact sheet pushes against the wire, the contact sheet can be deflected flexibly, so that the contact wire can be held in the wire clamp connector. Furthermore, the wire clamp connector may be applied to the wall mount component so as to be mounted on a wall and connected to an electronic product.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
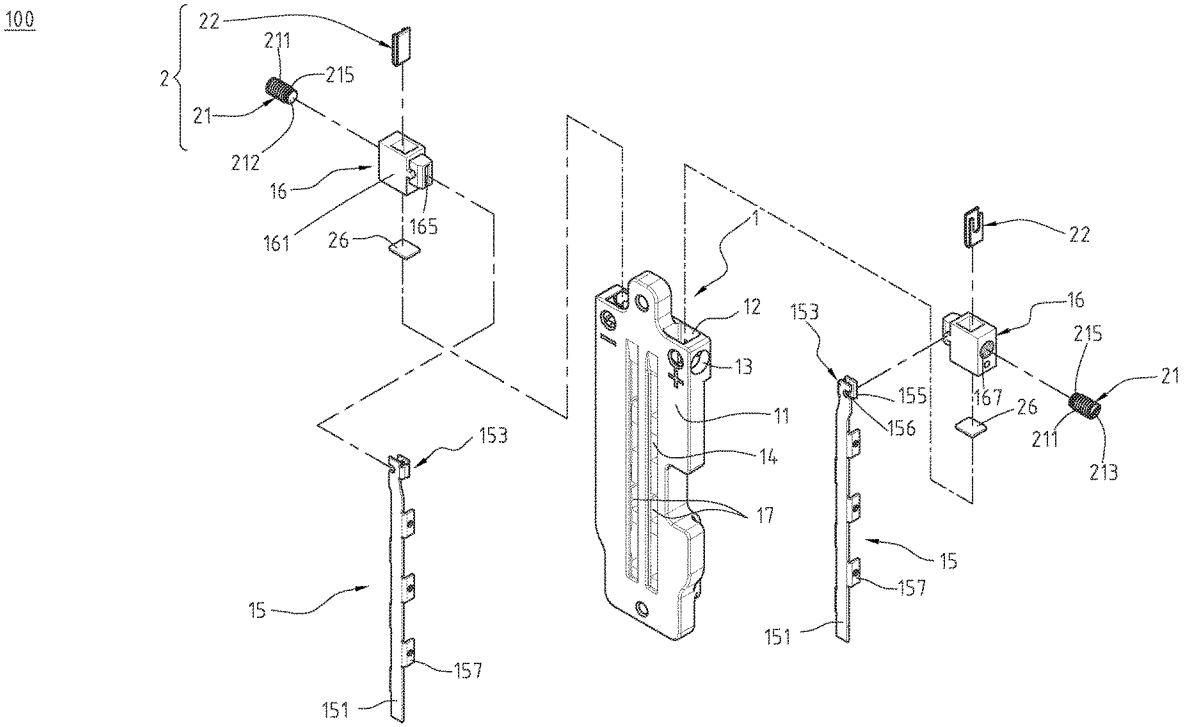
FIG. 1 illustrates an exploded view of a wire clamp connector according to a first embodiment of the instant disclosure.
Figure 2:
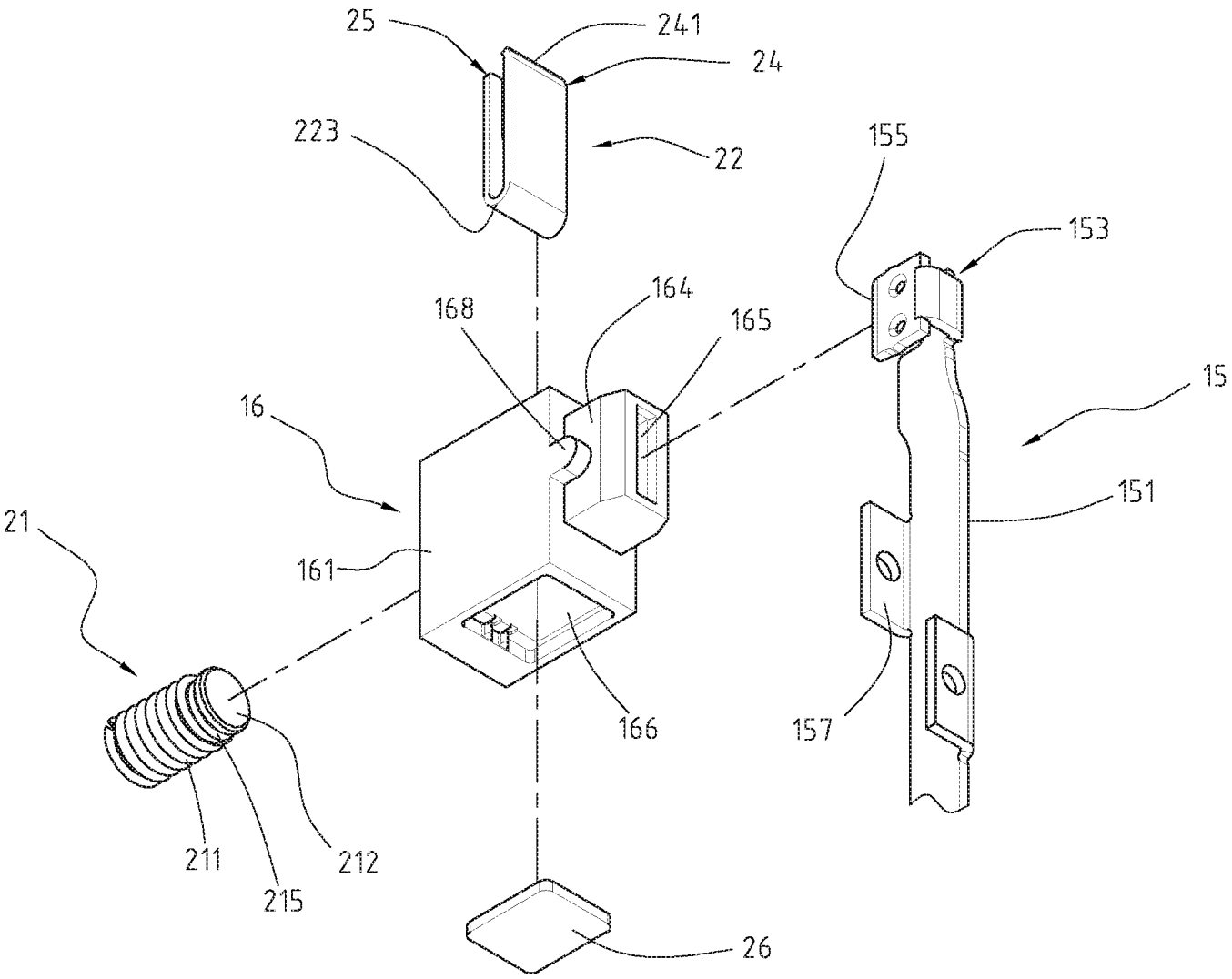
FIG. 2 illustrates a partial exploded view (1) of the wire clamp connector of the first embodiment.
Figure 3:
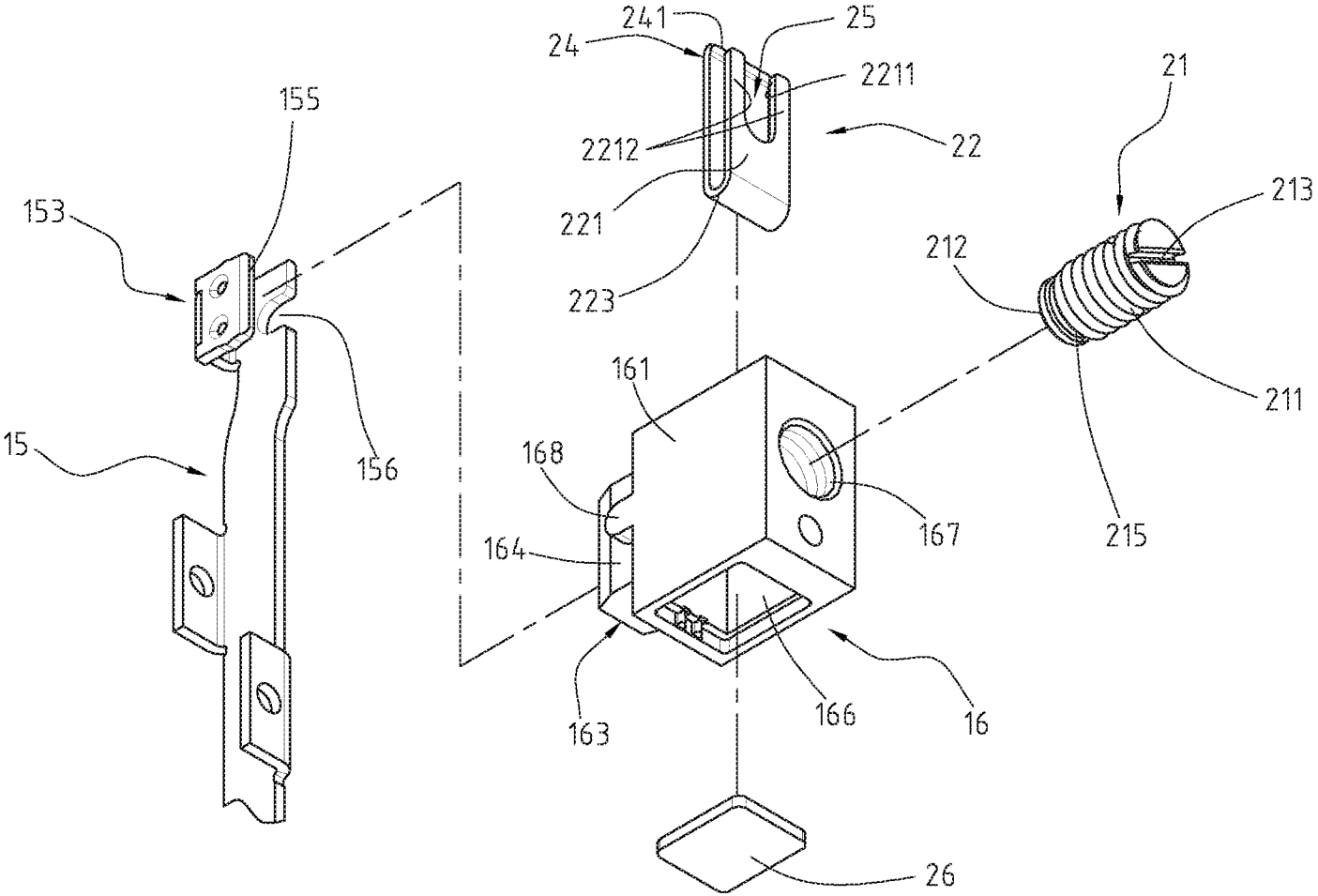
FIG. 3 illustrates a partial exploded view (2) of the wire clamp connector of the first embodiment.
Figure 4:
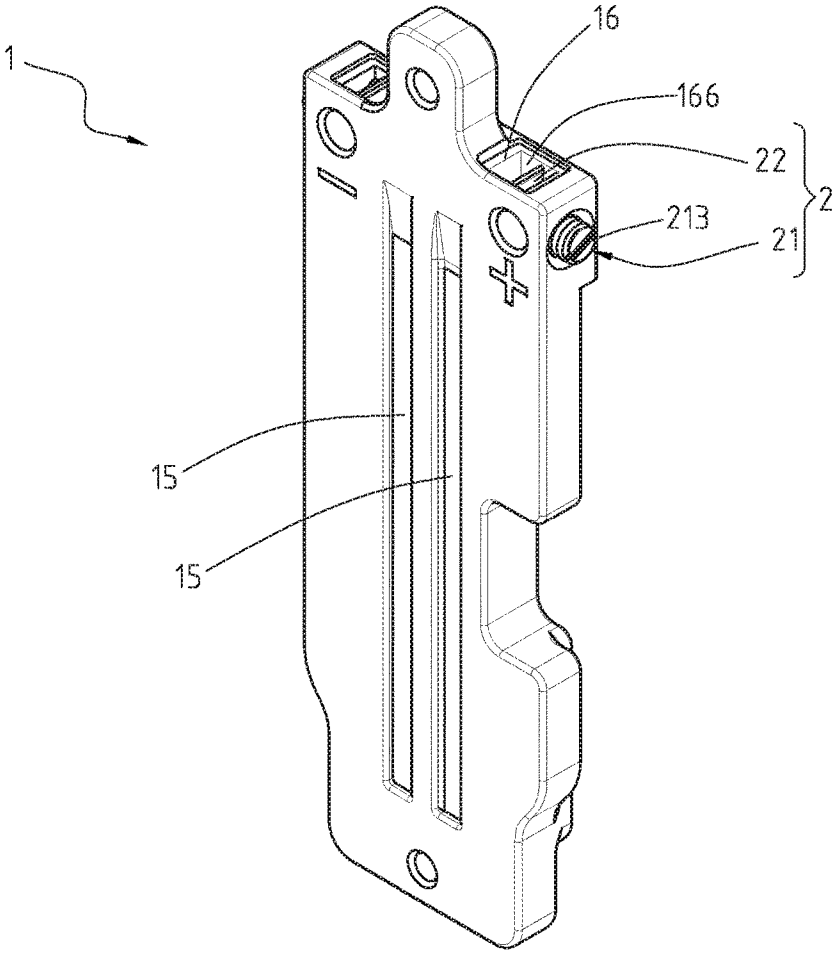
FIG. 4 illustrates a perspective view of the wire clamp connector of the first embodiment.

Please refer to FIGS. 1 to 4, which illustrate a wire clamp connector 100 of a first embodiment of the instant disclosure. FIG. 1 illustrates an exploded view of the wire clamp connector 100. FIG. 2 illustrates a partial exploded view (1) of the wire clamp connector 100. FIG. 3 illustrates a partial exploded view (2) of the wire clamp connector 100. FIG. 4 illustrates a perspective view of the wire clamp connector 100. In this embodiment, the wire clamp connector 100 comprises a connecting board 1, a plurality of conductive sheets 15, a plurality of conductive mounts 16, and a plurality of wire clamp components 2.

Please refer to FIGS. 1 and 4. The connecting board 1 is an elongate plate made of plastic. The connecting board 1 is insulated and nonconductive. The connecting board 1 comprises a board body 11, a plurality of recessed rails 14, a plurality of assembling holes 12, a plurality of through holes 13, and a plurality of engaging grooves 17. In this embodiment, the board body 11 is formed by injection molding or the like, and the recessed rails 14, the assembling holes 12, the through holes 13, and the engaging grooves 17 are formed on the board body 11, but embodiments are not limited thereto. In some embodiments, the board body 11 may be formed by combining several separated pieces. In this embodiment, the recessed rails 14 are at a lateral surface of the board body 11 and aligned side by side. The assembling holes 12 are at side portions of the top of the board body 11. The through holes 13 are at two sides of the board body 11 and communicating with the respective assembling holes 12. The engaging grooves 17 are respectively recessed from inner walls of each of the recessed rails 14 and aligned staggeringly. Specifically, the engaging grooves 17 of each of the two inner walls of the recessed rail 14 are spaced from each other, and the engaging grooves 17 of one of the two inner walls of the recessed rail 14 are not aligned with the engaging grooves 17 of the other inner wall of the recessed rail 14. In other words, a first right engaging groove at the right inner wall of the recessed rail is between a first left engaging groove and a second left engaging groove at the left inner wall of the recessed rail. A second right engaging groove at the right inner wall of the recessed rail is between the second left engaging groove and a third left engaging groove at the left inner wall of the recessed rail, and so forth.

Please refer to FIGS. 1 to 4. The conductive sheets 15 are metallic elongate plates disposed at the lateral surface of the board body 11. Each of the conductive sheets 15 comprises a contact plate 151, an assembling portion 153, and a plurality of engaging pieces 157 formed integrally with each other. Each of the contact plates 151 is positioned in the corresponding recessed rail 14, and each of the assembling portions 153 is extending laterally from the contact plate 151 toward the corresponding assembling hole 12. The engaging pieces 157 are extending outward and bilaterally from each of the contact plates 151 along the same direction, and the engaging pieces 157 of each of the contact plates 151 are aligned staggeringly. Specifically, the engaging pieces 157 of the left side of the contact plate 151 are not aligned with the engaging pieces 157 of the right side of the contact plate 151. In other words, a first right engaging piece at the right side of the contact plate is between a first left engaging piece and a second left engaging piece at the left side of the contact plate, a second right engaging piece at the right side of the contact plate is between the second left engaging piece and a third left engaging piece at the left side of the contact plate, and so forth. In addition, the engaging pieces 157 are engaged with the engaging grooves 17, respectively. Accordingly, the conductive sheets 15 can be securely fixed on the connecting board 1 because of the structural matching between the engaging pieces 157 and the engaging grooves 17.

Please refer to FIGS. 1 to 5. The conductive mounts 16 are hollowed structures made of metal. Specifically, the conductive mounts 16 are molded by zinc alloy. The conductive mounts 16 are disposed at two sides of the top of the board body 11. Each of the conductive mounts 16 comprises a mount body 161, a positioning portion 163, a wire groove 166, and a lock hole 167. The mount body 161 is positioned in the corresponding assembling hole 12. The positioning portion 163 is formed at one of two sides of the mount body 161 and connected to the corresponding assembling portion 153. The wire groove 166 is defined through the mount body 161. The lock hole 167 is formed at the other side of the mount body 161 and corresponds to the corresponding through hole 13. In this embodiment, inner threading patterns are formed in the inner wall of each of the lock holes 167. Moreover, the mount body 161 has openings defined at the top and the bottom, and the openings communicate with the wire groove 166. Accordingly, in this embodiment, a wire 7 may be inserted into the wire groove 166 from one of the two openings of the mount body 161.

Please refer to FIGS. 1 to 5. The wire clamp components 2 are disposed at the mount bodies 161, respectively. Each of the wire clamp components 2 comprises a lock member 21 and a clamping piece 22. The lock member 21 is provided for pushing the clamping piece 22 to move. In this embodiment, each of the lock members 21 is a structure having outer threading patterns and similar to a screw. In this embodiment, the lock members 21 are locked with the locked holes 167. Each of the lock members 21 comprises a rod 211, an abutting portion 212, and a lock groove 213. The abutting portion 212 is at one of two ends of the rod 211 and positioned in the corresponding wire groove 166, and the lock groove 213 is at the other end of the rod 211 and protruding from the corresponding through hole 13. In addition, the abutting portion 212 further comprises a head and a body, the width of the head is greater than the width of the body, and the body is between the head and the rod 211. The lock groove 213 is a recess having, may be, a bar-profile, a cross-profile, or a Torx-profile), so that the lock groove 213 can be mated with a flathead screwdriver, a Philips screwdriver, or a Torx screwdriver, and the rod 211 can be rotated along the lock hole 167.

Figure 5:
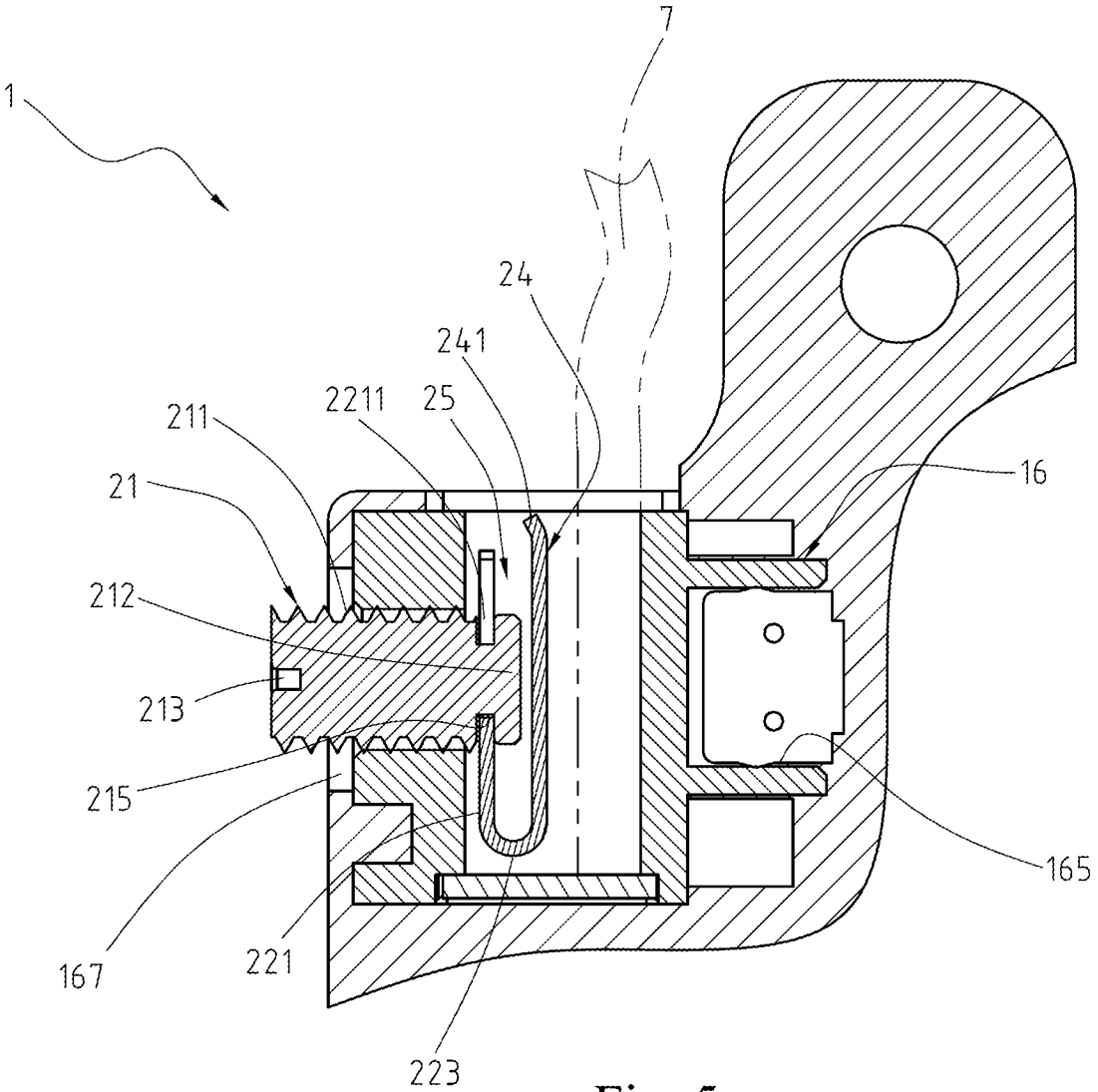
FIG. 5 illustrates a partial sectional view of the wire clamp connector of the first embodiment before a wire is clamped.

Please refer to FIGS. 2, 3, and 5. The cross section of the clamping piece 22 is approximately in U shaped. The clamping piece 22 is disposed in the wire groove 166 of the mount body 161. The width of the clamping piece 22 is slightly less than the width of the wire groove 166, so that the clamping piece 22 can be moved in the wire groove 166, and the two sides of the clamping piece 22 can be leaned against the inner wall of the wire groove 166. Therefore, the clamping piece 22 is not flipped over (overturn) during being moved in the wire groove 166. In addition, each of the clamping pieces 22 comprises a holding sheet 221, a bending portion 223, a contact sheet 24, and an elastic space 25. Each of the holding sheets 221 is assembled to the corresponding abutting portion 212. One of two ends of the bending portion 223 is extending from the bottom of the holding sheet 221. The contact sheet 24 is extending from the other end of the bending portion 223 and near to the holding sheet 221. In other words, the cross section of the holding sheet 221, the bending portion 223, and the contact sheet 24 is approximately in U shaped. The holding sheet 221 and the contact sheet 24 are substantially arranged parallel, and the flexible space 25 is formed between the holding sheet 221 and the contact sheet 24. The abutting portion 212 is disposed in the flexible space 25; in other words, the body of the abutting portion 212 is positioned on the holding sheet 221, while the head of the abutting portion 212 is positioned in the flexible space 25.

Please refer to FIGS. 2, 3, and 5. In this embodiment, the head of the abutting portion 212 is in the flexible space 25 and not in contact with the contact sheet 24. In other words, the head of the abutting portion 212 is spaced from the contact sheet 24 by an interval. Accordingly, when the contact sheet 24 pushes against the wire 7, the contact sheet 24 can be deflected flexibly, so that the contact sheet 24 can hold the wire 7 in the wire groove 166. While in some embodiments, the head of the abutting portion 212 is in the flexible space 25 and in contact with the contact sheet 24. In other words, the surface of the head of the abutting portion 212 is in contact with the contact sheet 24. Accordingly, when the head of the abutting portion 212 drives the contact sheet 24 to push against the wire 7, the force applied to the abutting portion 212 can be exactly transmitted to the contact sheet 24, so that the contact sheet 24 can hold the wire 7 in the wire groove 166 firmly.

Figure 6:
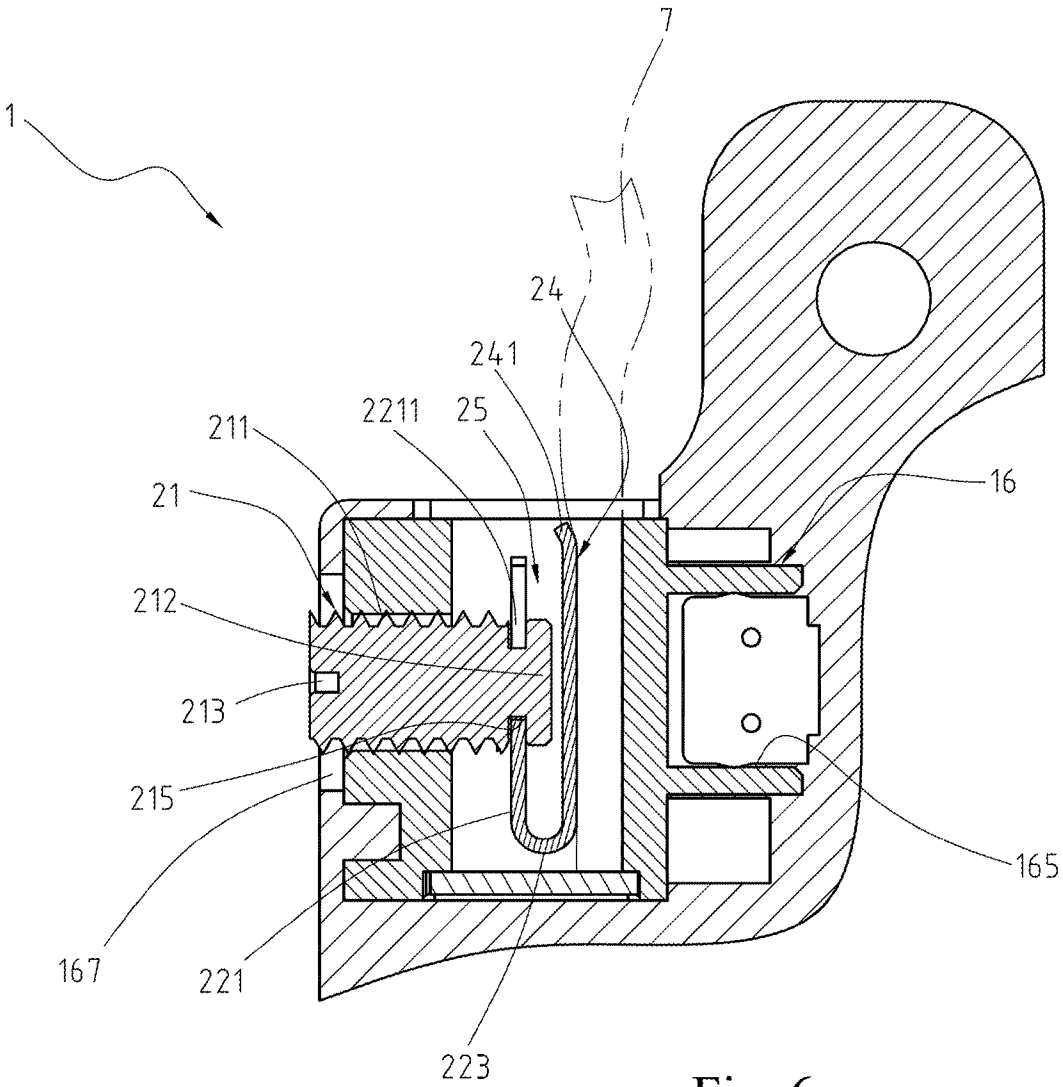
FIG. 6 illustrates a partial sectional view of the wire clamp connector of the first embodiment after a wire is clamped.

Please refer to FIGS. 5 and 6. It is understood that, when the wire 7 is held in the wire groove 166, one of two sides of the wire 7 is pressed by the contact sheet 24, and the other side of the wire 7 is abutted against the inner wall of the wire groove 166. In addition, the wire 7 is in contact with the conductive mount 16, and the conductive mount 16 is in contact with the conductive sheet 15, so that electricity can be transmitted from the wire 7 to the conductive mount 16 and the conductive sheet 15. Furthermore, because the wire 7 is pushed by the contact sheet 15 having a flat surface, the wire 7 is not damaged easily when being pressed by the contact sheet 24. Therefore, the problem that the wire 7 would be damaged by the tip of the screw when being fixed by the screw, as mentioned in the conventional, can be prevented.

Please refer to FIGS. 2 and 3. Each of the holding sheets 221 comprises a recessed groove 2211 and a plurality of side arms 2212. The recessed groove 2211 is recessed from the top of the holding sheet 221. The side arms 2212 are at two sides of the recessed groove 2211. Each of the lock members 21 comprises an annular groove 215 between the rod 211 and the abutting portion 212. The annular groove 215 is formed at one end of the lock member 21; specifically, the annular groove 215 may be formed at the periphery of the body of the abutting portion 212. The axis of the lock member 21 corresponds to a portion near to the middle portion of the contact sheet 24. Therefore, when the lock member 21 drives the holding sheet 221 to move, the contact sheet 24 is in contact with the wire 7 and positions the wire 7 in the wire groove 166. In addition, the side arms 2212 are respectively positioned at two sides of the annular groove 166. Therefore, when the lock member 21 is rotated, the clamping piece 21 would not be rotated along with the rotation of the lock member 21, and the clamping piece 21 is still movable along the radial direction of the lock member 21.

Please refer to FIGS. 2, 3, and 5. Each of the wire clamp components further comprises a cover plate. The cover plate 26 covers the wire groove 166 of the mount body 161. In other words, one of the two openings of the mount body 161 is for the insertion of the wire 7, and the cover plate 26 covers the other opening of the mount body 161, so that the clamping piece 21 can be prevented from being detached off the wire groove 166. Moreover, each of the clamping pieces 21 further comprises a guiding portion 241 extending and being bent inwardly from a side of the contact sheet 24, so that the wire 7 can be guided by the guiding portion 241 and inserted into the wire groove 166. In other words, the clamping piece 21 has a flat portion and an edge portion, the edge portion is extending from the flat portion and bent inward, and the edge portion is the guiding portion 241.

Please refer to FIGS. 2, 3, and 5. In this embodiment, the assembling portion 153 of each of the conductive sheets 15 comprises a buckle piece 155 extending from the contact plate 151 and extending upward and inward to a position above the contact plate 151. The cross section of the buckle piece 155 and the contact plate 151 is approximately U-shaped. In addition, each of the conductive sheets 15 comprises a recessed portion 156 formed at one side of the contact plate 151 and near to the buckle piece 155. The positioning portion 163 of each of the conductive mounts 16 comprises a protruding block 164 and a buckle groove 165. The protruding block 164 is laterally protruding from the mount body 161. The buckle groove 165 is recessed from the surface of the protruding block 164. The buckle piece 155 is fixed in the corresponding buckle groove 165. In addition, each of the conductive mounts 16 comprises an engaging block 168 laterally protruding from the protruding block 164 and assembled to the corresponding recessed portion 156. Hence, the fixation between the conductive sheets 15 and the conductive mounts 16 can be further improved. In this embodiment, the buckle piece 155 of the assembling portion 153 is hook shaped and buckled with the protruding block 164 of the positioning portion 163, but embodiments are not limited thereto. In some embodiments, the assembling portion 153 and the positioning portion 163 may be combined with each other by gluing, mating, or sleeving, and the combining ways allow the conductive pieces 15 to be in contact with the conductive mounts 16 for transmitting electricity.

Figure 7:
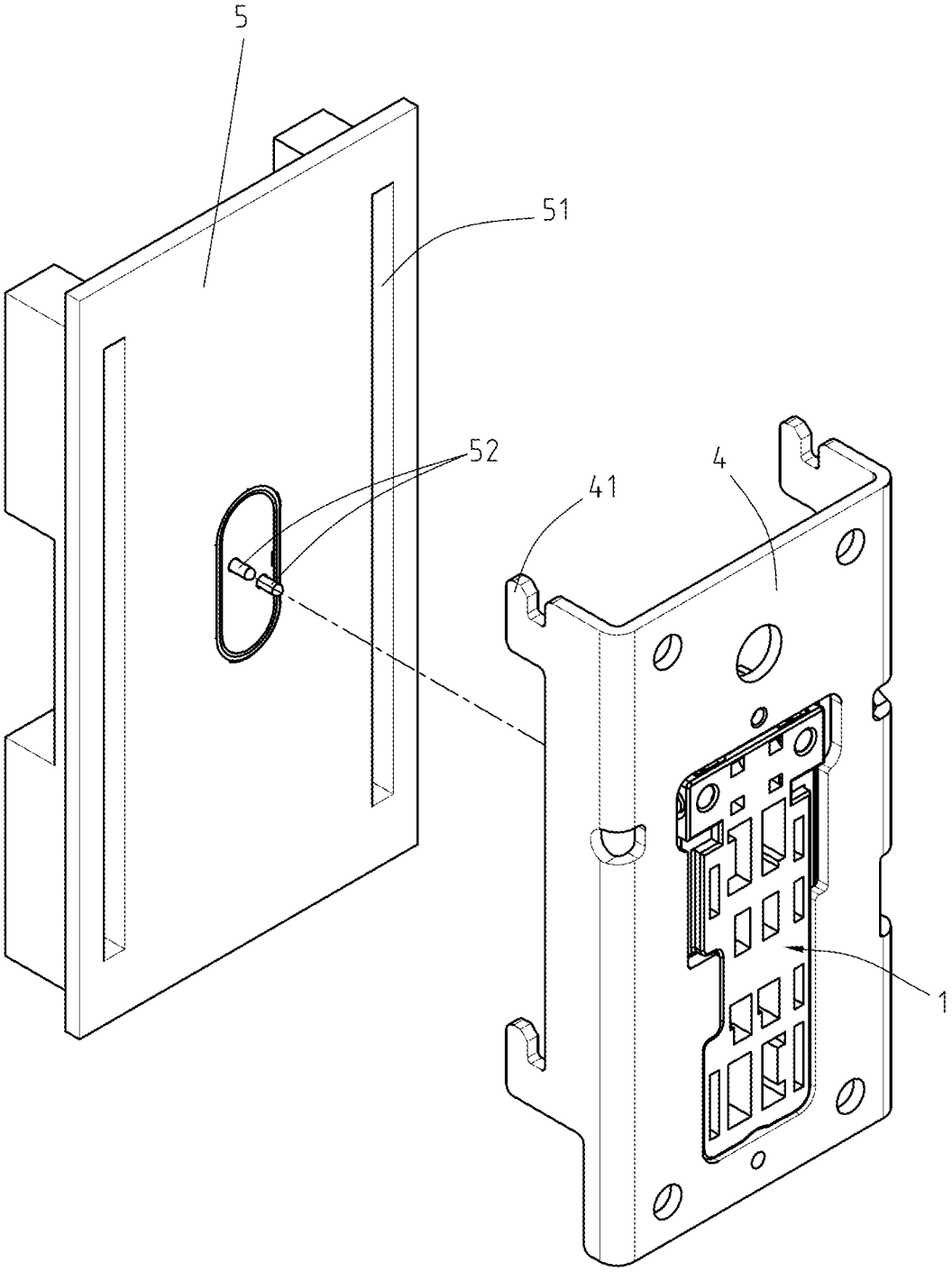
FIG. 7 illustrates an exploded view (1) of a wall mount component according to a second embodiment of the instant disclosure.
Figure 8:
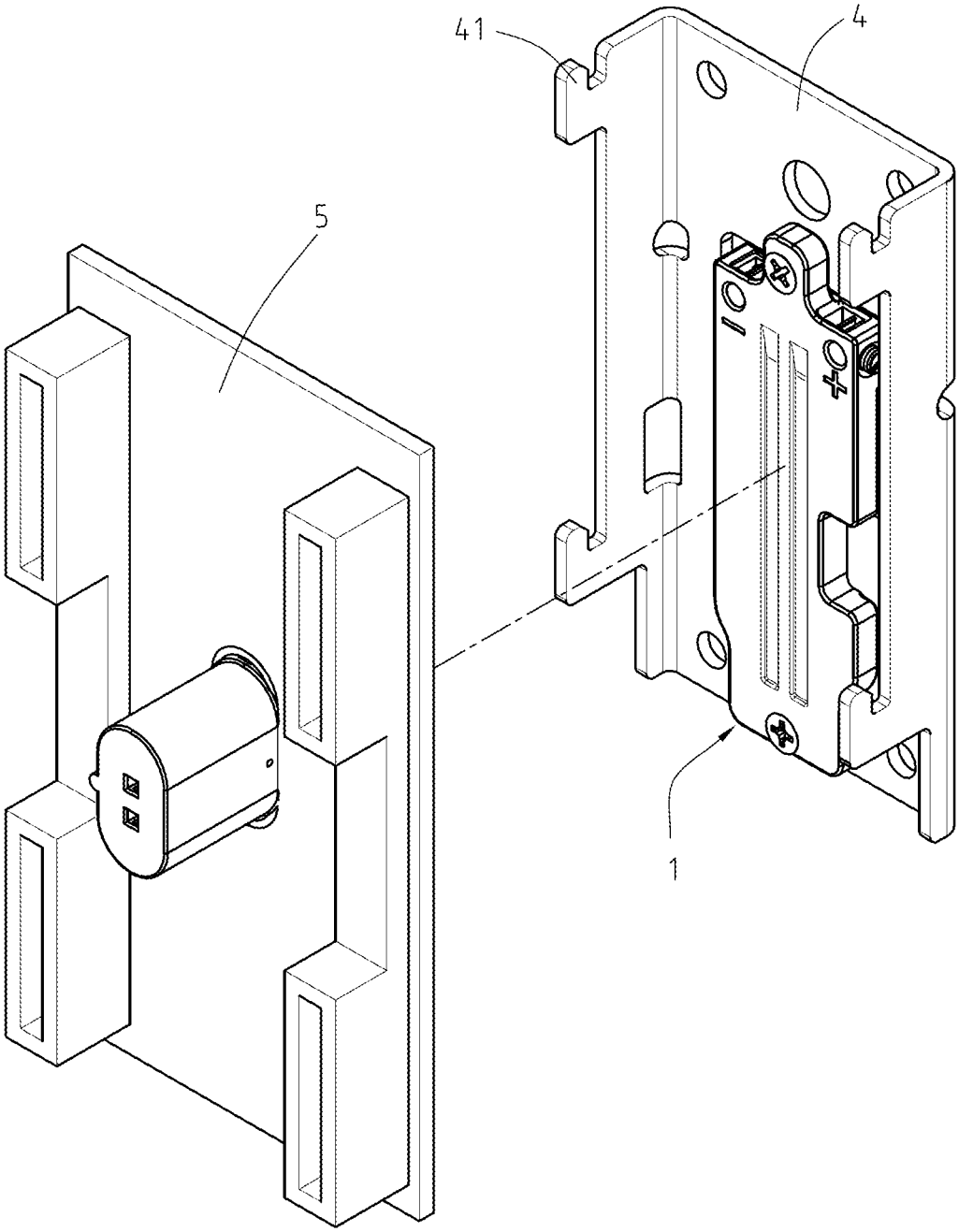
FIG. 8 illustrates an exploded view (2) of the wall mount component of the second embodiment.

Please refer to FIGS. 7 and 8, which illustrate a wall mount component 200 of a second embodiment of the instant disclosure. FIG. 7 illustrates an exploded view of the wall mount component 200, and FIG. 8 illustrates an exploded view from the back of the wall mount component 200. The wall mount component 200 comprises the wire clamp connector 100 mentioned in the first embodiment. In this embodiment, the wall mount component 200 comprises a bracket 4, a plurality of hooks 41, the wire clamp connector 100, a connecting pad 5, an engaging hole 51, and a plurality of conductive terminals 52.

Please refer to FIGS. 7 and 8. The cross section of the bracket 4 is an upside down U-shape. The bracket 4 comprises a plurality of hollowed holes for locking with the wire clamp connector 100, and further for locking the bracket 4 onto a wall. That is, one of two surfaces of the bracket 4 is locked with the wire clamp connector 100, and the other surface of the bracket 4 faces the wall. The conductive sheets 15 of the wire clamp connector 100 are opposite to the wall. The conductive mounts 16 of the wire clamp connector 100 are in the assembling holes 12 at the side portions of the top of the board body 1. Accordingly, when the wires 7 connected to main supply are inserted into the wire clamp connector 100, the lock members 21 are locked in the lock holes 167 to position the wires 7 within the wire grooves 166 through the hollowed holes. Hence, the clamping piece 22 can push the wire 7 against the inner wall of the wire groove 166 of the conductive mount 16 for preventing the wire 7 from being detached off the wire clamp connector 100. In addition, the hooks 41 are bilaterally extending upward from the bracket 4.

Please refer to FIGS. 7 and 8. The connecting pad 5 is an elongate plate and provided for assembling to an electronic device, e.g., an acoustics, a TV, etc. The connecting pad 5 is connected to the bracket 4. The engaging holes 51 are recessed from two sides of the connecting pad 5. The hooks 41 of the bracket 4 are respectively hooked with the engaging holes 51. The conductive terminals 52 are assembled to one surface of the connecting pad 5. One of two ends of each of the conductive terminals 52 is protruding from the surface of the connecting pad 5, and the other end of each of the conductive terminals 52 is electrically connected to a circuit board inside the electronic device. The conductive terminals 52 include positive terminals and negative terminals. The conductive terminal 52 may be a Pogo pin. The Pogo pin comprises a vacuum tube, a contact pin protruding from one side of the vacuum tube, and a spring structure in the vacuum tube. When the connecting pad 5 is connected to the bracket 4, i.e., when the electronic device is hanged on the wall, the conductive terminals 52 are respectively connected to the conductive sheets 15 of the wire clamp connector 100, so that the main supply can be transmitted to the electronic device through the wires 7, the wire clamp connector 100, and the conductive terminals 52.

Based on the above, the wire can be firmly positioned in the wire groove by the clamp piece having a flat surface, so that the wire would not be damaged easily as well as the wire can be in contact with the clamping piece. In addition, because the offset configuration of the engaging pieces of the conductive sheets, when the engaging pieces are respectively positioned with the engaging grooves of the connecting board, the fixation between the conductive sheets and the connecting board can be enhanced. Moreover, the abutting portion of the lock member is positioned in the U-shaped clamping piece, and the head of the abutting portion is in the flexible space of the clamping piece. The abutting portion is free from contacting the contact sheet of the clamping piece. When the contact sheet pushes against the wire, the contact sheet can be deflected flexibly, so that the contact wire can be held in the wire clamp connector. Furthermore, the wire clamp connector may be applied to the wall mount component so as to be mounted on a wall and connected to an electronic product.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A wire clamp connector, comprising:

a connecting board, comprising a board body, a plurality of recessed rails at a lateral surface of the board body, a plurality of assembling holes at side portions of a top of the board body, and a plurality of through holes at two sides of the board body and communicating with the respective assembling holes;

a plurality of conductive sheets disposed at the lateral surface of the board body, wherein each of the conductive sheets comprises a contact plate and an assembling portion, the contact plate is positioned in the corresponding recessed rail, the assembling portion is extending laterally from the contact plate toward the corresponding assembling hole;

a plurality of conductive mounts disposed at the board body, wherein each of the conductive mounts comprises a mount body, a positioning portion, a wire groove, and a lock hole, the mount body is positioned in the corresponding assembling hole, the positioning portion is formed at one of two sides of the mount body and connected to the corresponding assembling portion, the wire groove is defined through the mount body, the lock hole is formed at the other side of the mount body and corresponds to the corresponding through hole; and a plurality of wire clamp components disposed at the respective mount bodies, wherein each of the wire clamp components comprises:

a lock member locked with the corresponding lock hole, wherein the lock member comprises a rod, an abutting portion, and a lock groove, the abutting portion is at one of two ends of the rod and positioned in the corresponding wire groove, and the lock groove is at the other end of the rod and protruding from the corresponding through hole; and a clamping piece disposed in the wire groove of the corresponding mount body, wherein the clamping piece comprises a holding sheet, a bending portion, and a contact sheet, the holding sheet is assembled to the corresponding abutting portion, one of two ends of the bending portion is extending from a bottom of the holding sheet, the contact sheet is extending from the other end of the bending portion and near to the holding sheet.

2. The wire clamp connector according to claim 1, wherein each of the holding sheets comprises a recessed groove and a plurality of side arms, the recessed groove is recessed from a top of the holding sheet, the side arms are at two sides of the recessed groove, wherein each of the lock members comprises an annular groove between the rod and the abutting portion, the side arms are respectively positioned at two sides of the annular groove.

3. The wire clamp connector according to claim 1, wherein each of the clamping pieces comprises a flexible space formed between the holding sheet and the contact sheet, the abutting portion is disposed in the flexible space.

4. The wire clamp connector according to claim 1, wherein each of the clamping pieces comprises a guiding portion extending and being bent inwardly from a side of the contact sheet.

5. The wire clamp connector according to claim 1, wherein each of the wire clamp components comprises a cover plate covering the wire groove of the corresponding mount body.

6. The wire clamp connector according to claim 1, wherein each of the assembling portions comprises a buckle piece extending from the contact plate and extending upward and inward to a position above the contact plate, each of the positioning portions comprises a protruding block and a buckle groove, the protruding block is laterally protruding from the mount body, the buckle groove is recessed from the surface of the protruding block, the buckle piece is fixed in the corresponding buckle groove.

7. The wire clamp connector according to claim 6, wherein each of the conductive sheets comprises a recessed portion formed at one side of the contact plate and near to the buckle piece, wherein each of the conductive mounts comprises an engaging block laterally protruding from the protruding block and assembled to the corresponding recessed portion.

8. The wire clamp connector according to claim 1, wherein the connecting board comprises a plurality of engaging grooves respectively recessed from inner walls of each of the recessed rails and aligned staggeringly, wherein each of the conductive sheets comprises a plurality of engaging pieces respectively and bilaterally extending from each of the contact plates and aligned staggeringly, the engaging pieces are engaged with the respective engaging grooves.

9. A wall mount component, comprising a bracket, a plurality of hooks bilaterally extending from the bracket, and the wire clamp connector according to claim 1, wherein the wire clamp connector is assembled to one surface of the bracket.

10. The wall mount component according to claim 9, further comprising a connecting pad, a plurality of engaging holes recessed from two sides of the connecting pad, and a plurality of conductive terminals assembled to one surface of the connecting pad and connected to the wire clamp connector.

* * * * *